US006990985B1

(12) United States Patent
Allen et al.

(10) Patent No.: US 6,990,985 B1
(45) Date of Patent: Jan. 31, 2006

(54) APPARATUS AND METHOD FOR PROTECTING FINGERNAILS

(75) Inventors: Eileen Allen, Draper, UT (US); Chris Scheurn, Agoura Hills, CA (US)

(73) Assignee: Nail Savers, LLC, Salt Lake City, UT (US)

( * ) Notice: Subject to any disclaimer, the term of this patent is extended or adjusted under 35 U.S.C. 154(b) by 0 days.

(21) Appl. No.: 10/154,639

(22) Filed: May 24, 2002

Related U.S. Application Data

(63) Continuation-in-part of application No. 10/052,165, filed on Jan. 17, 2002, now abandoned.

(51) Int. Cl.
*A45D 29/00* (2006.01)

(52) U.S. Cl. ..... 132/200; 132/73; 2/21

(58) Field of Classification Search ..... 132/73, 132/73.5, 319, 75, 285; 2/21, 163, 456, 16, 2/457; D28/56, 57, 58, 59, 60
See application file for complete search history.

(56) References Cited

U.S. PATENT DOCUMENTS 496,610 A * 5/1893 Hurlbut ..... 220/281
2,020,343 A * 11/1935 Willing ..... 40/312
2,616,472 A * 11/1952 Carlson ..... 150/150
2,720,903 A * 10/1955 Pickren ..... 206/102
2,823,723 A * 2/1958 Cohn ..... 383/43
3,008,604 A * 11/1961 Garner ..... 220/87.1
3,063,487 A * 11/1962 Mullin ..... 150/150
3,160,186 A * 12/1964 Conley ..... 206/38.1
3,272,248 A * 9/1966 O'Farrell ..... 383/43
4,966,174 A * 10/1990 Stanczak ..... 132/73
4,989,728 A * 2/1991 Neyret et al. ..... 206/91
5,069,261 A * 12/1991 Ji ..... 150/150
5,623,980 A * 4/1997 McMahon ..... 150/150
5,699,816 A * 12/1997 Banes et al. ..... 132/285
2001/0037814 A1 * 11/2001 Meinschewnk ..... 132/73
2002/0059940 A1 * 5/2002 Cain-Kozma ..... 132/73

* cited by examiner

*Primary Examiner*—Eduardo C. Robert
*Assistant Examiner*—David Comstock
(74) *Attorney, Agent, or Firm*—Morriss O'Bryant Compagni, P.C.

(57) ABSTRACT

An apparatus and method for protecting a fingernail includes a cover which is formed to fit over the fingernail. The cover is made from a material which restricts ultraviolet light from contacting the fingernail, thus preventing yellowing when the user is tanning.

10 Claims, 3 Drawing Sheets

APPARATUS AND METHOD FOR PROTECTING FINGERNAILS

RELATED APPLICATIONS

The present application is a continuation-in-part application of U.S. patent application Ser. No. 10/052,165, filed Jan. 17, 2002 now abandoned.

BACKGROUND OF THE INVENTION

1. Field of the Invention

The present invention relates an apparatus and method for protecting fingernails. More particularly, the present invention relates to an apparatus and method for protecting fingernails from discoloration which can be caused by the use of tanning lights.

2. State of the Art

There are many things which an individual does to enhance his or her appearance. One common activity is the use of artificial ultraviolet lights to tan the user's skin. Other common activities include manicures and pedicures in which the fingernails and toenails are cleaned, shaped and polished to provide a pleasing look.

One trend in manicures which is presently popular is what is commonly referred to as a French manicure. In a French manicure, the ends of the person's fingernails are colored white. Each nail is then covered with a clear finish to provide a natural looking nail. Because of the time and skill involved, a French manicure can be relatively expensive.

One problem which is present for those who like French manicures and tanning is that the ultraviolet light used in the tanning booths tends to cause discoloration of the manicured fingernails. Thus, one may spend considerable amounts of time and money getting a French manicure only to have the fingernails begin to discolor after only a few visits to the tanning salon. While one may attempt to time the manicure after a visit to the tanning booth, tanning must typically be repeated at least weekly to maintain the effect. Within a week, the French manicure loses its aesthetic appeal because of the discoloration caused by the ultraviolet rays.

One attempt has been made to prevent discoloration of nails due to ultraviolet rays. Referring to FIG. 1, there is shown a perspective view of a fingernail cover, generally indicated at 10, which is currently being sold. The fingernail cover 10 has a hollow, generally cylindrical section 14 with an opening at a proximal end 18. An opposing distal end 22 has a wall 26 which closes the cylinder at the distal end. The cover 10 is preferably sized to fit over the distal end of a person's finger so as to cover the nail.

Turning to FIG. 1A, there is shown a perspective view of the fingernail cover 10 disposed on a finger 30. This is accomplished by advancing the distal end 34 of the finger 30 through the open proximal end 18 and into the cover 10 until the nail 38 is covered.

The cover 10 is made of a semi-resilient polymer, or some other material which restricts the flow of ultraviolet light to the nail 38. With the cover 10 positioned over the nail 38, the ultraviolet light which is being used for tanning does not contact the nail. Thus, the ultraviolet light cannot react with the fingernail 38 or the polish, etc., on the fingernail to cause yellowing.

While the cover 10 provides a marked improvement in the protection of nails from ultraviolet light, the cover has several drawbacks. First, although the round nature of the cover closely matches the curvatures of the end of each finger and facilitates placement of the cover onto the finger, they have a tendency to fall off during use.

Second, because of the shape of the covers, at least two different sizes must be used in the kits to keep the cover on the end of the finger. If a set of covers is all of the same size, it can be difficult to place a cover over the thumb, while the cover is so large that it will not stay on the finger. Of course, providing multiple sizes of fingernail cover in a set requires additional handling and supply concerns and adds to the cost of the product.

In one attempt to resolve these concerns, sizing tape was provided to make sizes fit a greater variety of fingers. The sizing tape, however, added expense and complexity to the product.

Thus, there is a need for a new apparatus and method for protecting fingernails for discoloration. Such an apparatus and method should be easy to use and relatively inexpensive.

SUMMARY OF THE INVENTION

Thus, it is an object of the present invention to provide a method for preventing discoloration of fingernails during tanning.

It is another object of the invention to provide an apparatus which is configured to shield the fingernails from ultraviolet light during tanning.

It is another object of the present invention to provide such a method and apparatus which is easy to use.

It is still another object of the present invention to provide such a method and apparatus which is relatively inexpensive.

The above and other objects of the invention are realized in specific illustrated embodiments of an apparatus and method for preventing discoloration of fingernails during tanning. The apparatus includes a cover which is configured to receive the distal end of a finger, including a fingernail to cover the same. The method includes covering the fingernail with a material which is resistant to travel of ultraviolet light while the hand of the user is subjected to ultraviolet light.

In accordance with one aspect of the invention, the cover is typically formed with an elongated opening for receiving the distal end of the finger and fingernail. As the finger is slid through the elongate opening, the top and bottom walls of the cover engage the top and bottom of the finger to hold the cover in place. Because of the elongate nature of the opening, however, a variety of different finger sizes can be slid into a single size of a cover, without the cover falling off when the hand is moved. The cover is left in place until the tanning session is completed and then removed. Preferably, the cover is configured to allow repeated use.

In accordance with another aspect of the invention, the cover comprises a pliable material which is releasably attachable to the fingernail so as to shield the fingernail from exposure to ultraviolet light while tanning.

BRIEF DESCRIPTION OF THE DRAWINGS

The above and other objects, features and advantages of the invention will become apparent from a consideration of the following detailed description presented in connection with the accompanying drawings in which.

DETAILED DESCRIPTION

Reference will now be made to the drawings in which the various elements of the present invention will be given numeral designations and in which the invention will be discussed so as to enable one skilled in the art to make and use the invention. It is to be understood that the following description is only exemplary of the principles of the present invention, and should not be viewed as narrowing the pending claims.

Figure 2:
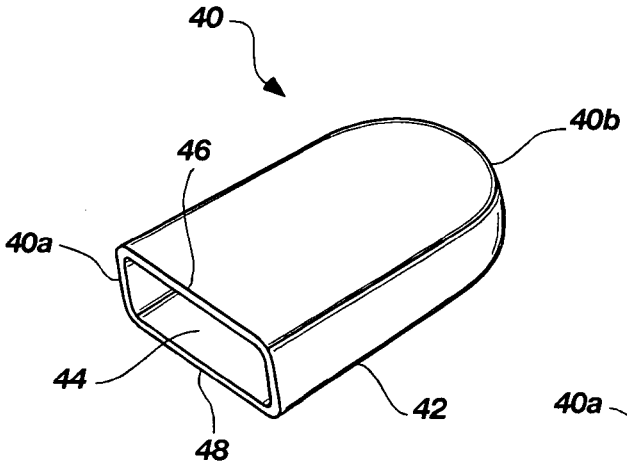
FIG. 2 shows a perspective view of a nail cover formed in accordance with the principles of the present invention.

Referring to FIG. 2, there is shown a perspective view of a fingernail cover, generally indicated at 40, made in accordance with the teachings of the present invention. The fingernail cover 40 is generally hemi-elliptical in shape and has sidewalls 42 which define an opening 44 at one end 40*a*. The opposing end 40*b* is closed.

Figure 1:
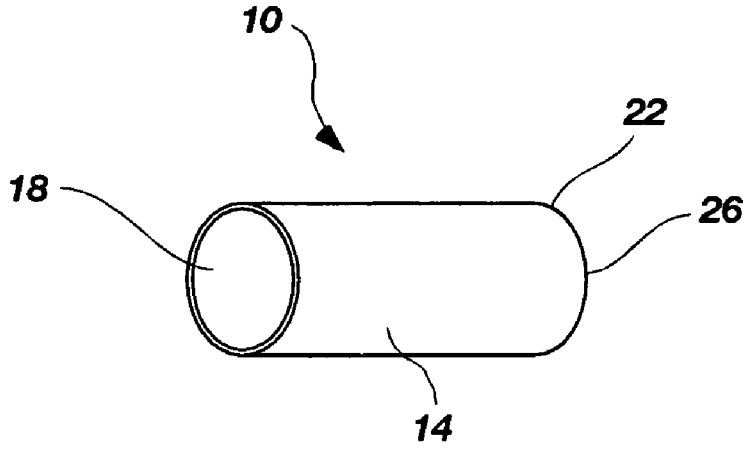
FIG. 1 (PRIOR ART)
FIG. 1 shows a perspective view of a fingernail cover made in accordance with the principles of the prior art.
Figure 2A:
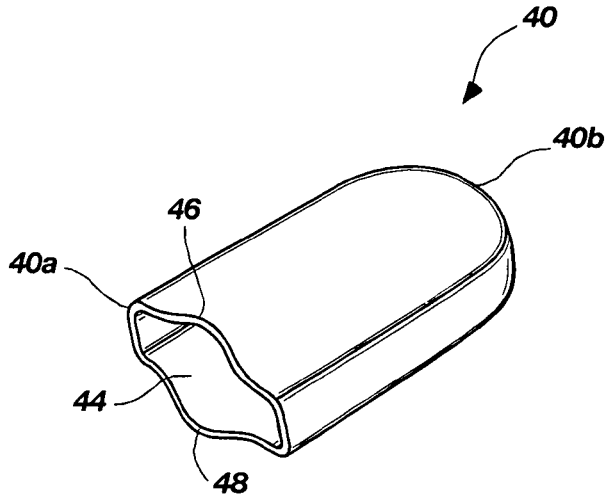
FIG. 2A shows a perspective view of a nail cover as it is distended by placement of a finger therein.

Unlike the prior art shown in FIG. 1, the opening 40 is elongated so that it is wider than it is high. Preferably, the opening is at least twice as wide as it is high, and most preferably has a width to height ratio of 3:1 to 5:1. In a typical embodiment, the opening is between ¾ and 1¼ inches wide and about ¼ of an inch high. Thus, the opening is sized to permit entry of a finger therein, while causing upward and downward deflection of the upper wall 46 and the lower wall 48 as shown in FIG. 2A.

In accordance with the present invention, it has been found that the elongated opening 44 resolves the problems of the prior art. In particular, because the upper wall 46 and the lower wall 48 can deflect outwardly, a single size of cover will fit all of the fingers and the thumb of an individual. Thus, there is no need to package separate sizes in a single package. This reduces cost and handling time.

In addition to the sizing concern, the covers 40 are much better at staying on the fingers of the user. The covers are made of a resilient material and the upper wall 46 and the lower wall 48 have a bias back toward their original shape. Thus, the upper wall 46 and the lower wall 48 exert a very small amount of pressure on the end of the finger, thereby holding cover 40 in place. With such covers 40, it is unlikely that the cover will fall of the user's finger during use. Additionally, it is preferred that the cover not be advanced so that the sidewalls engage the finger. By leaving a space between the sidewall and the finger open, the risk of the cover being suctioned to the user's finger are reduced and difficulty in removing the cover can be avoided.

Figure 2B:
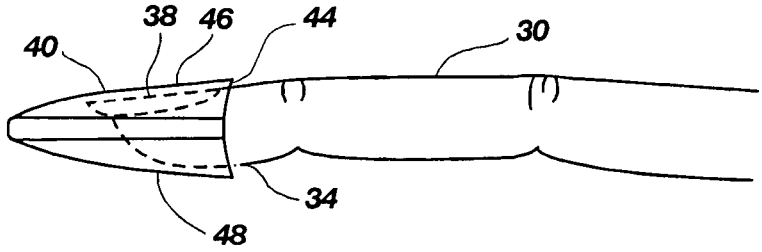
FIG. 2B shows a side view of the fingernail cover formed in accordance with FIG. 2 disposed on a finger.

Turning to FIG. 2B, there is shown a perspective view of the fingernail cover 40 disposed on a finger 30. This is accomplished by advancing the distal end 34 of the finger 30 through the opening 44 until the nail 38 is covered. Unlike the prior art, the cover 40 need not be advanced until it cannot be advanced further. This has the added benefit of not leaving ring marks in the skin of the finger adjacent the finger nail. Rather, the upper wall 46 and the lower wall 48 simply deflect sufficiently to allow entry of the distal end 34 of the finger 30 and apply a force to the finger which is so small as to be barely noticeable as it holds itself in place.

The cover 40 is made of a semi-resilient polymer, such as vinyl or some other material which restricts the flow of ultraviolet light to the nail. By providing a semi-resilient or resilient material, the cover 40 will flex to conform to the end of different fingers.

With the cover 40 positioned over the nail 38, the ultraviolet light which is being used for tanning does not contact the nail. Thus, the ultraviolet light cannot react with the fingernail or the polish, etc., on the fingernail to cause yellowing.

Because the covers 40 can withstand hundreds, if not thousands of exposures to tanning bed ultraviolet light, a small investment in covers can save a considerable amount in manicures.

Figure 1A:
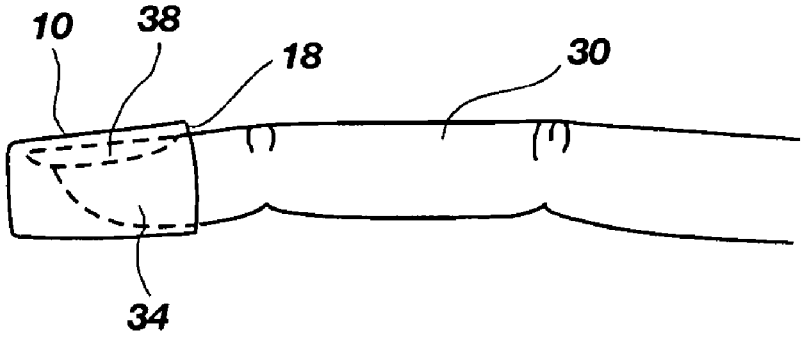
FIG. 1A (PRIOR ART)
FIG. 1A shows a side view of a finger having a cover in accordance with FIG. 1 disposed thereon.
Figure 3:
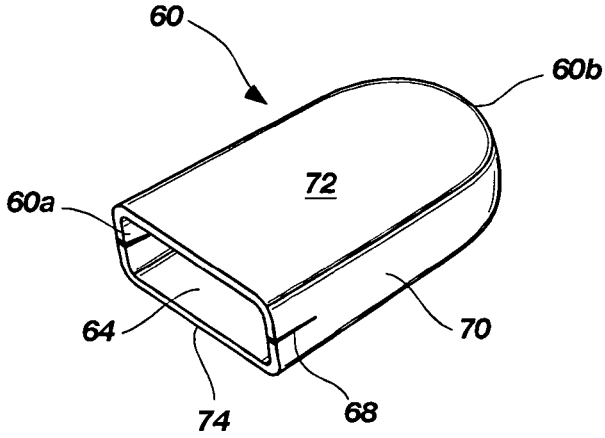
FIG. 3 shows a perspective view of another embodiment of the present invention disposed on a fingernail.

Turning now to FIG. 3, there is shown an alternate configuration of covers, generally indicated at 60, made in accordance with the principles of the present invention. The covers 60 is hemi-elliptical and has an opening 64 in the proximal end 60*a* and a closed distal end 60*b*. Unlike the covers 10 in FIGS. 1 and 1A, the opening 64 in the proximal end 60*a* is elongated. Additionally, one or more slits 68 are disposed in the sidewall 70.

Figure 3A:
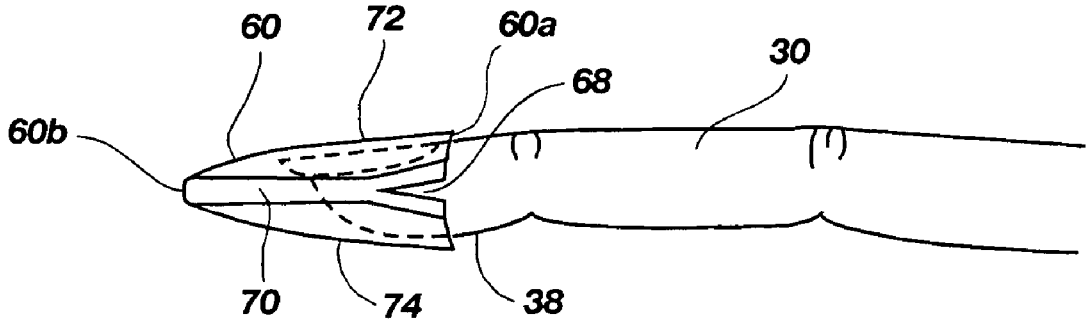
FIG. 3A shows a side view of the fingernail cover of FIG. 3 mounted on the end of a finger.

As shown in FIG. 3A, the slits 68 allow the upper wall 72 and lower wall 74 to deflect to a greater degree. This enables a single size of cover to fit virtually all sizes of fingers. Those skilled in the art will appreciate that having a single size saves considerable time in manufacturing and handling costs.

Figure 4:
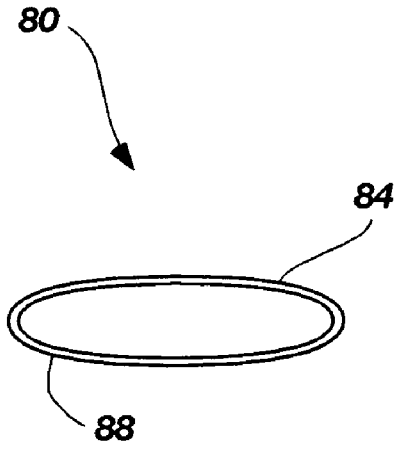
FIG. 4 shows a perspective view of yet another embodiment of a fingernail cover.

Turning now to FIG. 4, there is shown yet another embodiment of a cover, generally indicated at 80, made in accordance with the principles of the present invention. The cover 80 is generally oblong so as to cover the nail. If desired, the cover 80 can be made from a material which may be easily cut to conform to the shape of the fingernail.

While an upper part 84 of the cover 80 is made from a material which restricts the flow of ultraviolet light, the underside 88 of the cover is formed from a material which provides a weak adhesive property. This can be accomplished by using a releasable adhesive, such as those used on removable note pads, or by a material which tends to adhere to the materials on the fingernail through static cling. With the cover 80 positioned over the fingernail, the fingernail is protected from ultraviolet light. For added security, a cover may also be placed on the underside of long fingernails to prevent ultraviolet light penetrating the nail from underneath.

Thus there is disclosed an improved apparatus and method for protecting fingernails and toenails. Those skilled in the art will appreciate numerous modifications which can be made without departing from the scope and spirit of the present invention. For example, the distal end of the covers in FIGS. 1 through 2A could be left open or partially open while still substantially protecting the nail. Additionally, slits could be added to the prior art covers to improve their ability to hold the user's fingers. The appended claims are intended to cover such modifications.

What is claimed is:

1. A cover for fingernails comprising:

a piece of ultraviolet light-resistant material sized to proximate the size of a user's fingertip and configured to accommodate fingertips of varying sizes, said piece having a rectangular-shaped open end that is wider than it is high with a width to height ratio of from about 2:1 to about 5:1 and said piece being configured for receiving and being worn on the distal end of a user's finger thereby enclosing the end of the finger.

2. A cover for fingernails, the cover comprising:

a piece of ultraviolet light-resistant material having a top wall, a bottom wall, an opening and an inside surface, said piece of ultraviolet light-resistant material being configured for receiving the distal end of a user's finger and further comprising at least two sidewalls for providing an accommodation of said cover to varying sizes of fingertips by applying a lateral force to said sidewalls, said top wall and said bottom wall having sufficient flexibility to provide a compressive force to a user's fingertip, and said inside surface further comprising adhesive disposed on at least a portion thereof to contact the finger.

3. The cover of claim 2 wherein said adhesive is located to contact a fingernail.

4. The cover of claim 2 wherein said top wall and said bottom wall are substantially flat and oriented parallel to each other to provide contact between said top wall and said bottom wall with a fingertip.

5. A cover for fingernails, the cover comprising an ultraviolet light-resistant member sized to proximate the size of a user's fingertip and being configured for receiving and being worn on the distal end of a user's fingertip thereby enclosing the end of the finger and user's fingernail, said member having a flattened top wall, a flattened bottom wall in parallel orientation to said top wall, sidewalls joining said top wall and bottom wall and an opening that is wider than it is high, said member being configured such that said sidewalls are compressible toward each other to enlarge said opening for receiving the distal end of a user's finger and such that when said sidewalls are released, said top wall and said bottom wall are brought into simultaneous contact with a user's fingertip and further comprising an inside surface and having an adhesive disposed on at least a portion of said inside surface of said cover.

6. A method for protecting a fingernail from yellowing while in a tanning booth, the method comprising:

a) selecting a cover sized to accommodate fingers of varying sizes having an upper wall, a lower wall, sidewalls, a length and an opening of rectangular shape, said opening being wider than it is high and configured to fit over the fingernail of a finger to enclose the fingertip in a manner such that the sidewalls do not engage the finger;

b) advancing said cover over the fingertip until said upper wall and lower wall engage the fingertip to hold said cover on the fingertip; and c) subjecting said finger to ultraviolet light in a tanning booth.

7. The method according to claim 6, wherein the method further comprises selecting a cover having slits in opposing orientation and extending from said opening of said cover.

8. A method for protecting a fingernail from yellowing while in a tanning booth, the method comprising:

a) selecting a cover sized to accommodate fingers of varying sizes having a flattened top wall, a flattened bottom wall oriented parallel to said top wall, sidewalls and an opening, said opening being wider than it is high and configured to fit over the fingertip of a user to enclose and cover the fingernail;

b) placing the cover over the fingertip by compressing said sidewalls of said cover together to enlarge said opening to receive a fingertip and then releasing said sidewalls to bring said top wall and said bottom wall into contact with said fingertip; and c) subjecting said finger to ultraviolet light in a tanning booth.

9. The method according to claim 8, wherein the width to height ratio of said cover is between about 2:1 and 5:1.

10. The method according to claim 8 wherein said sidewalls have a defined length extending from said opening and said cover has at least one slit therein extending from said opening a distance which is less than half said length of said sidewalls to facilitate accommodation of said cover over a fingernail.

* * * * *